United States Patent [19]

Daniels

[11] Patent Number: 4,867,418

[45] Date of Patent: Sep. 19, 1989

[54] APPARATUS FOR INCREASING THE LOAD HANDLING CAPABILITY OF SUPPORT AND MANIPULATING EQUIPMENT

[75] Inventor: Charles K. Daniels, Houston, Tex.

[73] Assignee: N.L. Industries, Inc., New York, N.Y.

[21] Appl. No.: 296,847

[22] Filed: Jan. 12, 1989

Related U.S. Application Data

[63] Continuation of Ser. No. 211,132, Jun. 22, 1988, abandoned, which is a continuation of Ser. No. 835,458, Mar. 3, 1986, abandoned.

[51] Int. Cl.[4] ..... B66D 1/00

[52] U.S. Cl. ..... 254/277; 254/392; 254/900

[58] Field of Search ..... 254/277, 392, 900

[56] References Cited

U.S. PATENT DOCUMENTS

| | | | |
|---|---|---|---|
| Re. 28,218 | 10/1974 | Hanes et al. | 254/900 X |
| 3,743,249 | 7/1973 | van Daalen | 254/277 X |
| 3,788,073 | 1/1974 | Castela et al. | 254/900 X |
| 3,791,628 | 2/1974 | Burns et al. | 254/277 X |
| 3,804,183 | 4/1974 | Duncan et al. | 254/277 X |
| 3,841,770 | 10/1974 | Childs | 403/106 |
| 3,877,680 | 4/1975 | Childs et al. | 254/394 X |
| 3,912,227 | 10/1975 | Meeker et al. | 254/277 X |
| 3,940,111 | 2/1976 | Castela et al. | 254/392 X |
| 4,421,173 | 12/1983 | Beakley et al. | 254/277 X |
| 4,535,972 | 8/1987 | Millheim et al. | 254/277 |

*Primary Examiner*—Stuart S. Levy
*Assistant Examiner*—Katherine Matecki
*Attorney, Agent, or Firm*—Browning, Bushman, Zamecki & Anderson

[57] ABSTRACT

A method and apparatus for increasing the load handling capacity of a system, having at least one fluid driven compensating means, incorporates a booster fluid actuated piston cylinder assembly interconnecting portions of the compensating system so as to substantially affect the force reacting characteristics thereof, whereby greater loads will produce lesser movement of the compensating means.

3 Claims, 4 Drawing Sheets

FIG. 5
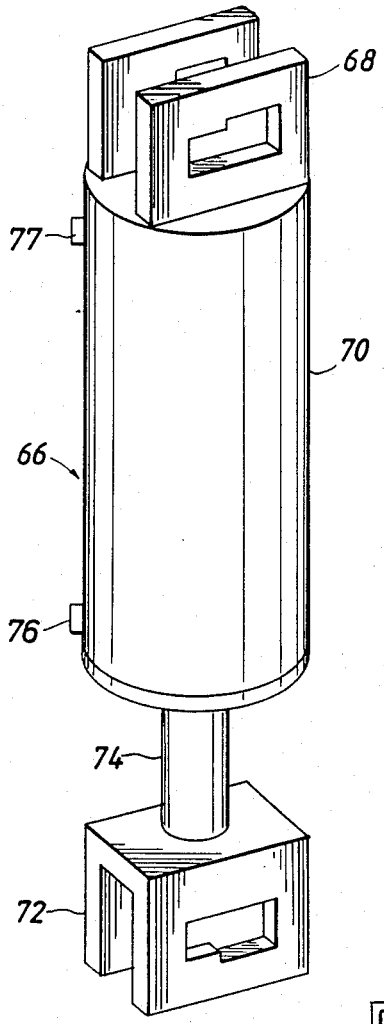
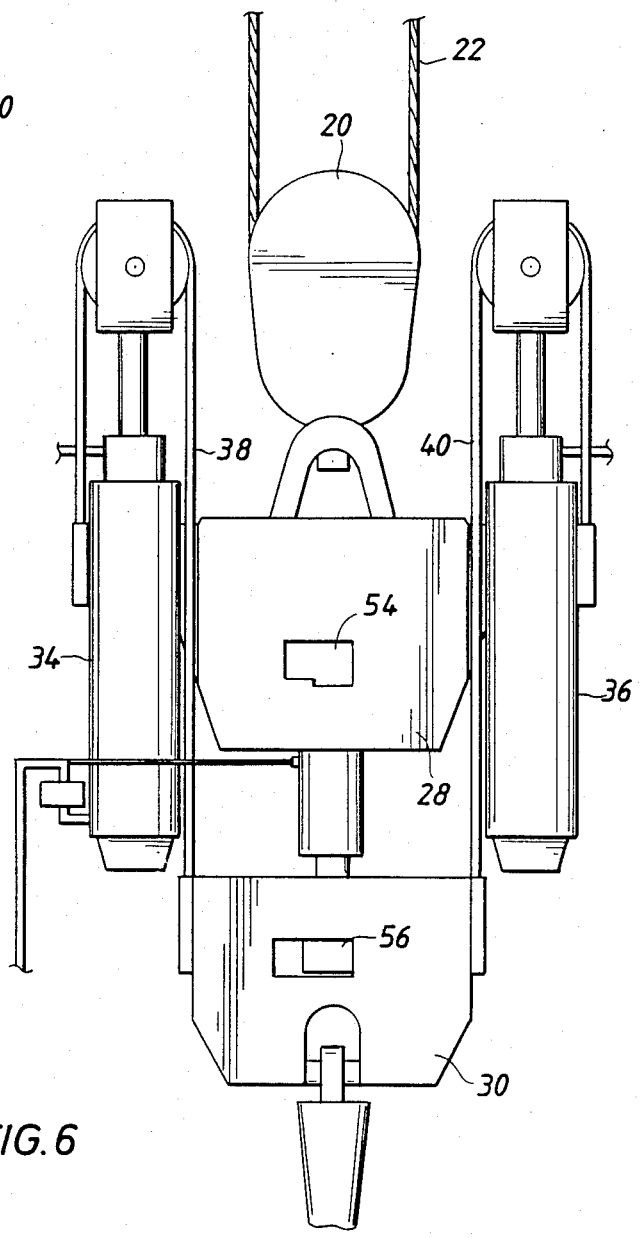
FIG. 6

APPARATUS FOR INCREASING THE LOAD HANDLING CAPABILITY OF SUPPORT AND MANIPULATING EQUIPMENT

This is a continuation of co-pending application Ser. No. 07/211,132 filed on June 22, 1988, now abandoned, which is a continuation of Ser. No. 06/835,458 filed Mar. 3, 1986, now abandoned.

BACKGROUND OF THE INVENTION

1. Field of the Invention

The present invention pertains to a method and apparatus for increasing the capacity of loads which can be handled by supporting and manipulating equipment. More particularly, the present invention finds use in load handling apparatus including blocks and lines, such as a traveling block to which a load can be connected and a crown block from which the traveling line is suspended by means of a line arrayed between sheaves forming parts of the two blocks. The present invention finds particular application to instances where one of the two blocks is further provided with motion compensating means, such as would be used in a marine environment where wave action would impart movement to the support means.

2. Description of the Prior Art

It is known to use motion compensating devices to compensate for the vertical motion imparted to marine vessels by wave action. The motion compensators are necessary when the vessel is supporting submerged equipment, as for example, during drilling or other undersea operations. Such vessels usually have a derrick fixed to the deck of the vessel with a crown block at the upper end of the derrick and a traveling block suspended from the crown block by a line arrayed between the sheaves of the blocks. The traveling block has a hook from which an elevator or the like is connected to depend into the water to the ocean floor. A fluid actuated system provides a reciprocal motion to allow the hook to be maintained at a fixed location relative to the undersea floor as the traveling block heaves with the wave action imparted to the vessel. Such compensators require the weight of the compensation apparatus to be supported by the same line by which the traveling block is suspended from the crown block which is fixed to the mast or derrick.

Motion compensators are known for keeping either the crown block or the traveling block stationary relative to the undersea floor as the floating vessel moves. In either case, the respective block is supported by means of a pair of direct acting hydraulic or pneumatic piston-cylinder assemblies. Additional compensation apparatus might be required to relieve linear movement of the flexible line supporting the block to prevent relative movement between the two blocks as a result of the vessel movement.

It is desirable and advantageous to provide a compensator supported by fluid and/or gaseous pressure assemblies providing balanced support and positioning to minimize the required height of the derrick or mast supporting the crown block and traveling block combination. It is also desirable to minimize the height of the derrick by providing maximum mechanical advantage so that a relatively large motion of the derrick can be compensated by a lesser relative movement between the compensator assembly components. It is also desirable to have the capability of substantially increasing the load handling capacities of the assembly during certain operations requiring that higher than normal loads be supported by the compensating means without unduly affecting the rest of the apparatus so as to maintain a high degree of motion sensitivity while supporting and compensating normal loads. It would not be cost effective to design the apparatus for such peak load capacities under all situations nor could load sensitivity be maintained if the apparatus were designed for the higher loads.

SUMMARY OF THE INVENTION

The present invention provides a method and apparatus for increasing the load handling capability of compensated systems having a crown block and a traveling block supported in a mast and intnerconnected by a line in an array about the sheaves of said blocks, the load being connected to the traveling block and compensating means being provided attached to one of said blocks whereby motion of the derrick is not imparted to the traveling block so that the load suspended therefrom maintains its relative position with regard to an oceanbed. The present invention is formed by a fluid actuated piston-cylinder assembly which is selectively mounted in said compensating system to provide additional capacity by increasing the amount of force necessary to produce movement of the compensation system. The fluid actuation can be achieved by hydraulic, pneumatic or combined hydraulic and pneumatic means.

The present invention provides a method and apparatus for increasing the load handling capability of a rig including a crown block and a traveling block, one of which has compensating means, by providing a piston-cylinder assembly which is selectively inserted into the compensating means so as to increase the resistance thereof to movement thereby enabling greater loads to be handled by the apparatus.

BRIEF DESCRIPTION OF THE DRAWINGS

The present invention will now be described by way of example with reference to the accompanying drawings in which:

FIG. 5 is a perspective view of the booster assembly according to the present invention; and FIG. 6 is a side elevation, similar to FIG. 2, showing the subject invention in a mounted condition.

DETAILED DESCRIPTION OF THE PREFERRED EMBODIMENT

Figure 1:
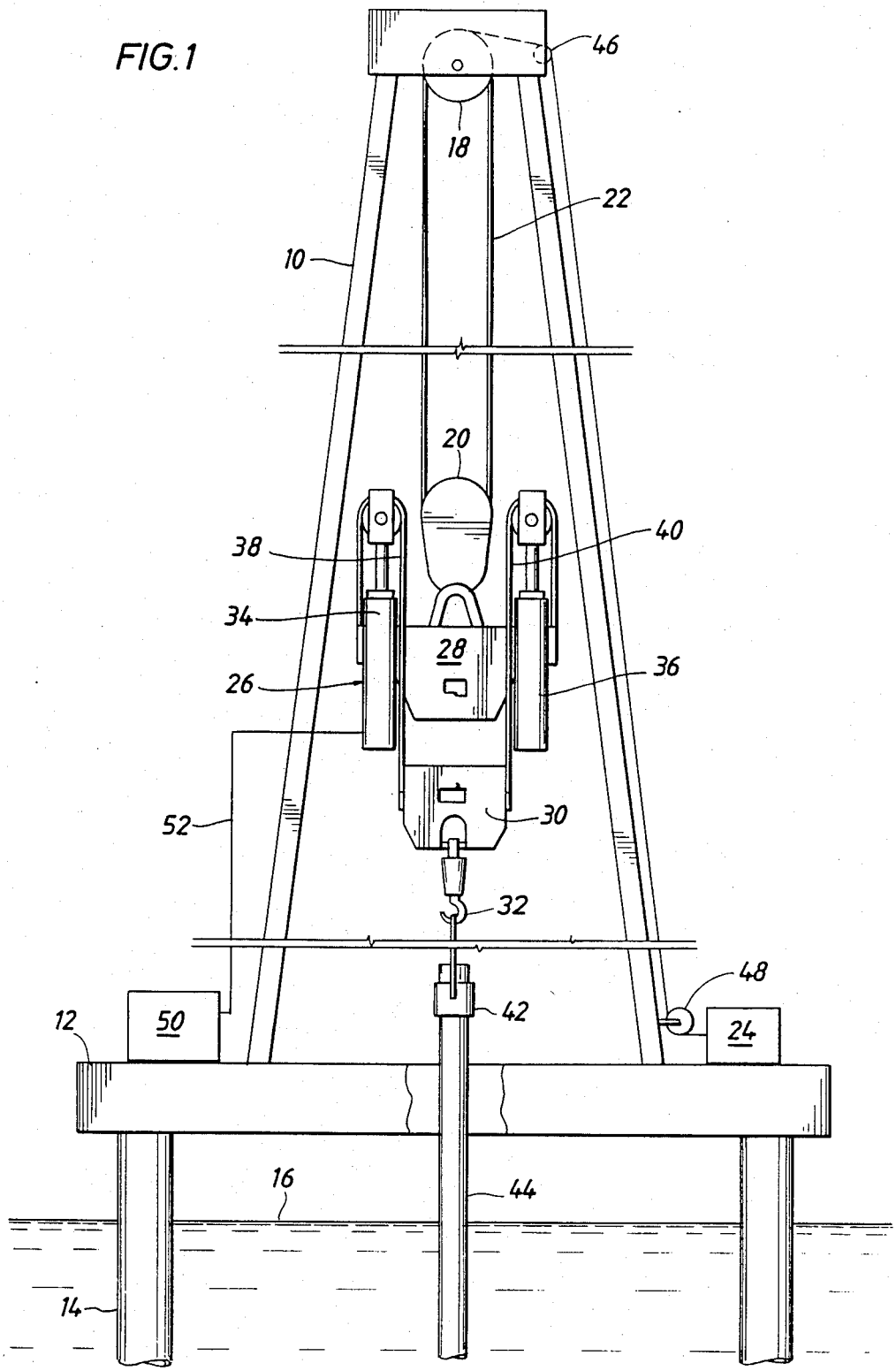
FIG. 1 is a schematic side elevation of a semi-submersible platform with a derrick or mast supporting a crown block and traveling block combination with a compensator included with the traveling block.
Figure 2:
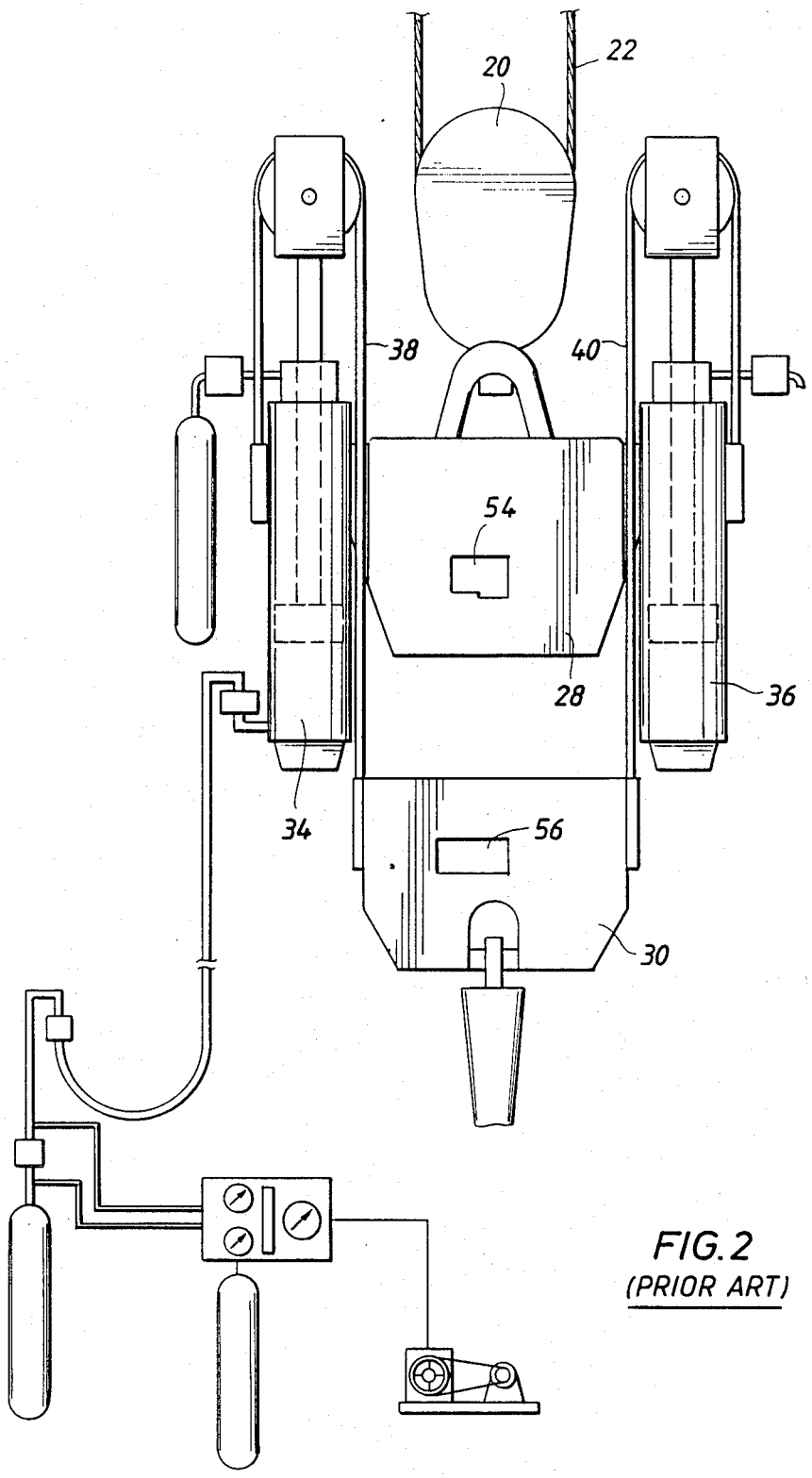
FIG. 2 (PRIOR ART)
FIG. 2 is a side elevation, partially schematic, of the compensator and traveling block combination.

The present invention is shown in the figures as it would be used in an offshore well drilling system in which a derrick or mast 10 is mounted on a semi-submersible platform 12 supported by flotation devices 14 in a body of water 16. A crown block 18 is mounted at the top of the mast 10 and has a traveling block 20 suspended therefrom by means of a line 22 in an array about the sheaves of the respective blocks and connected to draw works 24. In the embodiment illustrated, a compensation means 26 is connected to the traveling block 20 and includes a main frame 28, a hook frame 30 from which a hook 32 is suspended and a pair of piston cylinder assemblies 34, 36 and chains 38, 40 which interconnect the main frame 28 and hook frame 30. An elevator 42 is suspended from the hook 32 and engages the load 44, which is here illustrated as a tubular member representing a drill string, casing section, or any other equipment as might be used in an underwater drilling operation. The compensation apparatus 26 accommodates the platform motion while allowing the load 44 to be maintained at a relatively fixed location with respect to the underwater floor and well or to be selectively maneuvered relative to the seabed or well regardless of the heaving motion of the platform 12.

The operation of the rig is well known. One end of the line 22 is fixed to the mat or one of the two blocks and passes about the sheaves of the blocks over pulleys 46 and 48 to the drawworks 24. The winding in and paying out of the line from the drawworks causes the relative movement of the traveling block with respect to the common block.

In the embodiment illustrated, the traveling block is equipped with a compensator 26 which includes a main frame 28 and a hook frame 30 interconnected by means of the piston cylinder assemblies 34, 36 and the chains 38, 40. Fluid pressure for the piston cylinder assemblies 34, 36 is provided from a fluid pressure source 50 through flexible conduits 52. The source and lines can include either and/or both hydraulic and pneumtic pressurized fluid as required. The main frame 28 and hook frame 30 are provided with lock bar slots 54, 56, respectively, and one of the frames is provided with a lock bar assembly as shown in FIG. 3.

Figure 3:
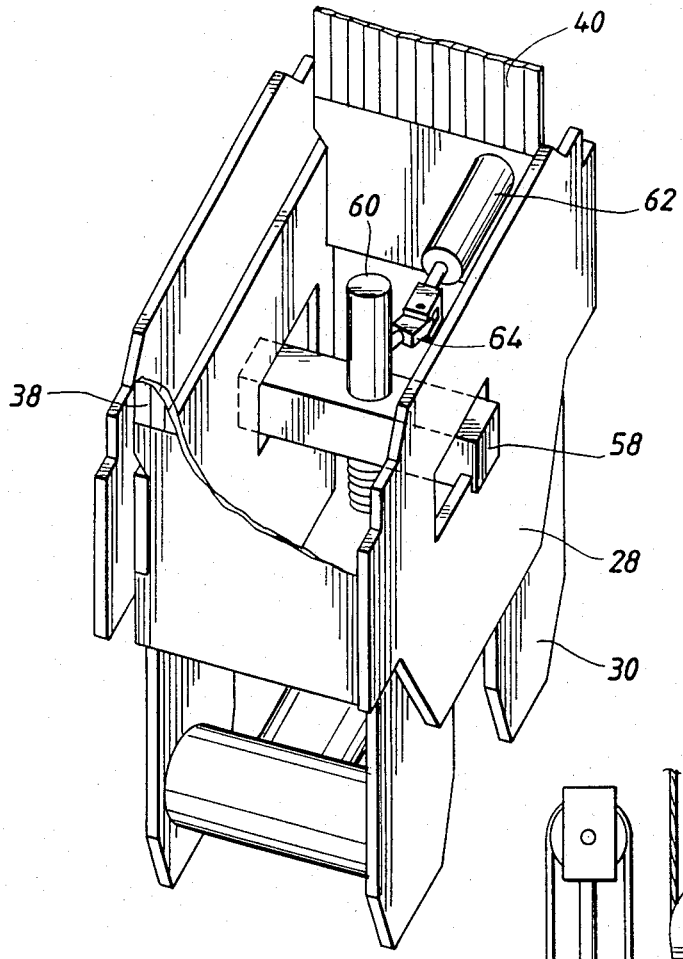
FIG. 3 is a perspective view of the lock bar assembly of the compensator according to FIG. 2.
Figure 4:
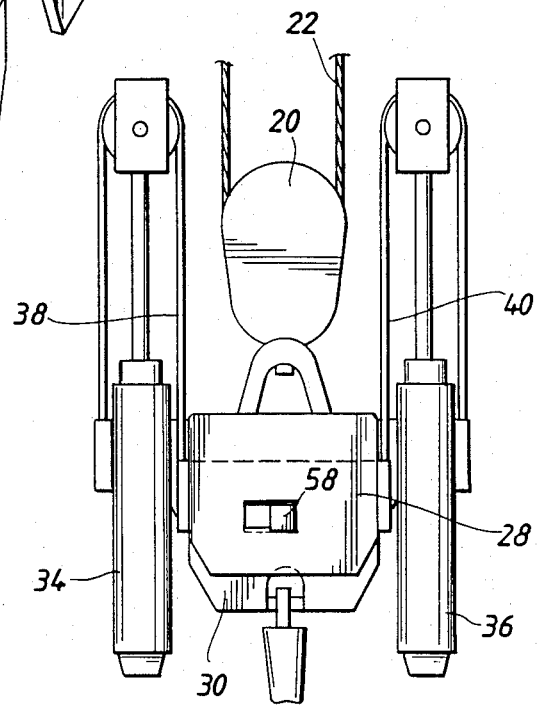
FIG. 4 (PRIOR ART)
FIG. 4 is a side elevation similar to FIG. 2 showing the portions of the compensator in a locked together condition.

The lock bar assembly shown in FIG. 3 is in the hook frame 30 and includes a lock bar 58 rotatably mounted on a shaft 60 with an actuating cylinder 62 connected by lever arm 64 to impart a rotary motion to the lock bar 58.

In some instances, it is desirable to incapacitate the compensation means 26, and this is accomplished by bringing the hook frame 30 and main frame 28 together and locking them together with the lock bar 58 by rotating the bar so that the ends thereof extend through the respective slots 54, 56.

At other times, it is desirable to increase the capacity for handling loads, and this is accomplished through the use of the present invention, as shown in FIGS. 5 and 6. The present invention includes a booster piston cylinder assembly 66 having a first mounting means 68 on a first end of a cylinder assembly 70 and a second mounting means 72 on the free end of the piston rod 74. The cylinder 70 includes couplings 76 for applying an actuating pressurized hydraulic or pneumatic fluid to the assembly, and couplings 77 to provide velocity control of fluid/piston movement.

When it is desired to increase theload capabilities of the system, the booster assembly 66 would be mounted between the main frame 28 and the hook frame 30 by the respective mounting means 68, 72 engaging in lock bar mechanisms, as shown in FIG. 3. Preferably, both the main frame 28 and the hook frame 30 would be provided with lock bar mechanisms to accommodate the present invention, but it will be readily understood that a simple bar (not shown) passing through the appropriate frame slot and mounting means would serve. The coupling 76 of the booster assembly 66 would be connected to the conduit 52 and supplied by the fluid pressure source 50.

An example of a suitable lock bar mechanism is shown and described in U.S. Pat. No. 3,841,770, the disclosure of which is incorporated herein by reference. Also, a compensation means of the type which could utilize the present invention is shown in co-pending U.S. patent application Ser. No. 666,874 filed Oct. 31, 1984, the disclosure of which is also incorporated herein by reference. The application discloses and claims a compensation means that is associated with the crown block, as distinguished from the traveling block of the present embodiment. However, either type of compensation means would benefit from the present invention.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. Apparatus for supporting and manipulating an object from a structure movable with respect to said object, said apparatus comprising:

a flexible line;

a first block secured to the structure and equipped with at least one sheave for engagement with the flexible line;

a second block equipped with at least one sheave for engagement with the flexible line such tht the second block is supported from the flexible line by the first block and is selectively movable with respect thereto by manipulating the line;

a main frame supported by and movable with the second block;

a hook frame supported by and movable with respect to the main frame for carrying the object;

fluid pressurizing means for controlling fluid pressure in a flow line;

motion compensation means connected to said flow line for movably interconnecting the main frame and the hook frame while simultaneously allowing movement of the main frame relative to the object carried by the hook frame in response to a change in fluid pressure in the fluid line while the second block remains stationary with respect to the first block; and booster means connected to said flow line and responsive to the change in the hydraulic pressure in the flow line and movably interconnecting the main frame and the hook frame in parallel with the motion compensation means to oppose movement of the hook frame relative to the main frame and thereby increase the load handling capability of the motion compensating means.

2. The apparatus as defined in claim 1, wherein the booster means further comprised as:

a piston and cylinder assembly having an upper attachment means and a lower attachment means each adapted for removably mounting the piston and cylinder assembly between the main frame and hook frame, respectively.

3. The apparatus as defined in claim 2, further comprising:

latch means for selectively fixing the position of the main frame relative to the hook frame.

* * * * *